United States Patent [19]

Clunn

[11] Patent Number: 5,033,247

[45] Date of Patent: Jul. 23, 1991

[54] CLEAN ROOM CEILING CONSTRUCTION

[76] Inventor: Gordon E. Clunn, P.O. Box 655, Cypress, Tex. 77429-0655

[21] Appl. No.: 521,898

[22] Filed: May 11, 1990

Related U.S. Application Data

[63] Continuation of Ser. No. 323,685, Mar. 15, 1989, Pat. No. 4,967,530.

[51] Int. Cl.[5] ..... E04B 5/52

[52] U.S. Cl. ..... 52/484; 52/397; 52/823

[58] Field of Search ..... 52/397, 400, 484, 823

[56] References Cited

U.S. PATENT DOCUMENTS

| | | | |
|---|---|---|---|
| 2,810,460 | 10/1957 | Winnan | 52/823 X |
| 3,427,776 | 2/1969 | Lake et al. | 52/397 X |
| 3,456,410 | 7/1969 | Olson et al. | 52/400 X |
| 3,565,473 | 2/1971 | Kedel | 52/484 X |
| 4,407,099 | 10/1983 | McLaughlin | 52/397 X |
| 4,611,444 | 9/1986 | Nassof | 52/484 X |
| 4,683,699 | 8/1987 | Larsson | 52/484 X |

*Primary Examiner*—John E. Murtagh
*Assistant Examiner*—Deborah McGann Ripley
*Attorney, Agent, or Firm*—Sroufe, Zamecki, Payne & Lundeen

[57] ABSTRACT

A suspension ceiling for clean room installations is disclosed. The ceiling has a suspended ceiling support structure having a plurality of grid openings including a vertical member between each grid opening and flanges extending horizontally from each vertical member so as to form a horizontal surface around a periphery of each grid opening for peripherally supporting a ceiling insert therein. At least one ceiling panel is positioned in a grid opening and peripherally supported by the flanges. An edge cap sealingly engages the ceiling panel edge surface for inhibiting particle emission therefrom. The edge cap comprises an elongated rigid or semi rigid strip of generally U-shaped cross-section having first and second horizontal portions respectively compressively engaging the periphery of the back and front ceiling panel horizontal surfaces and a vertical portion joining the first and second horizontal strip portions adjacent the ceiling panel edge surface. A gasket is secured to the second horizontal strip portion and compressed against the flange surface to form a seal around the periphery of the grid opening. There is also disclosed an assembly for sealing the edge of the grid suspension ceiling panel, and a prefabricated ceiling panel including the edge sealing assembly.

14 Claims, 3 Drawing Sheets

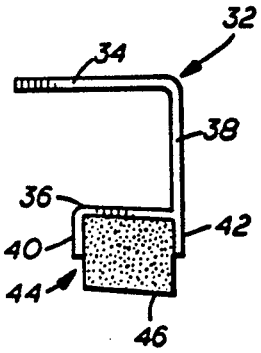
FIG. 5
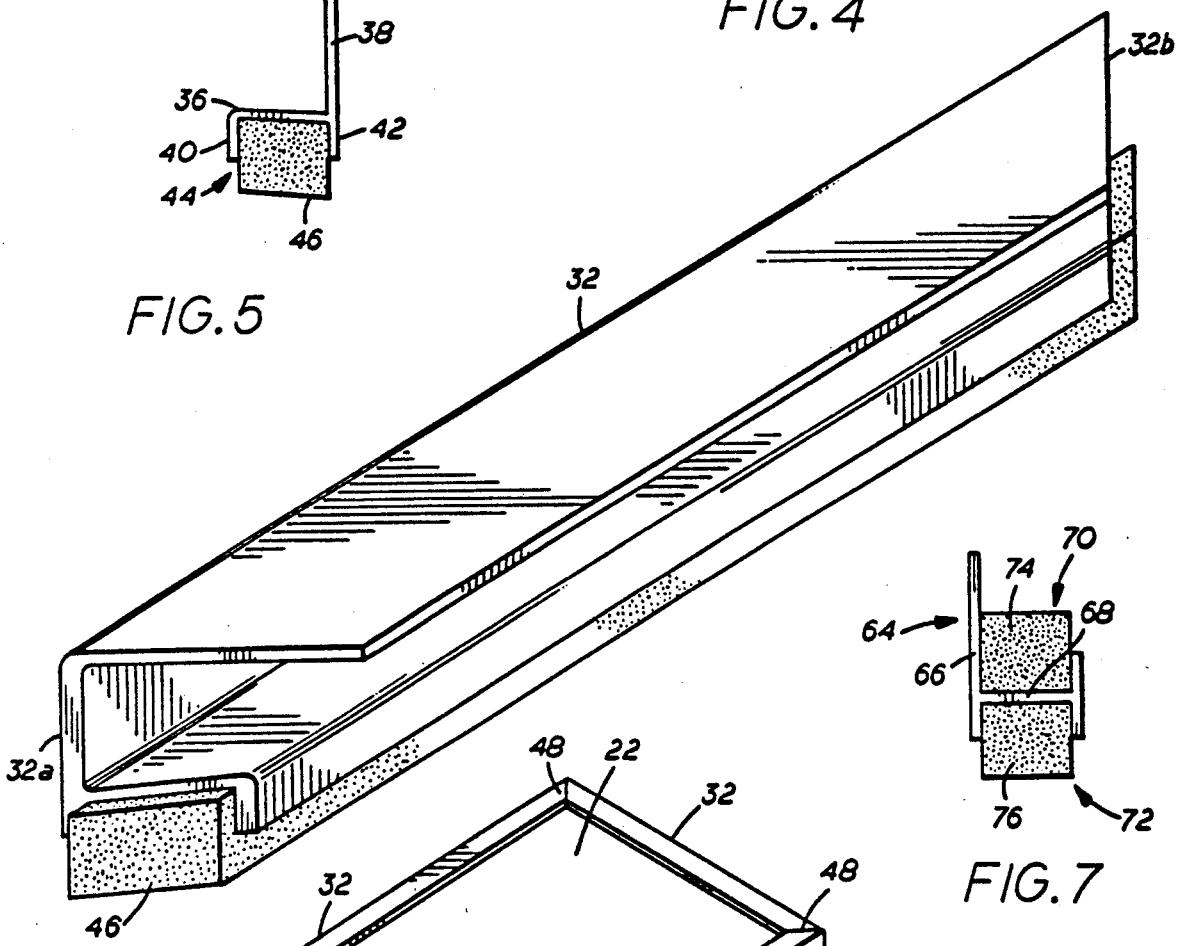
FIG. 4
FIG. 7
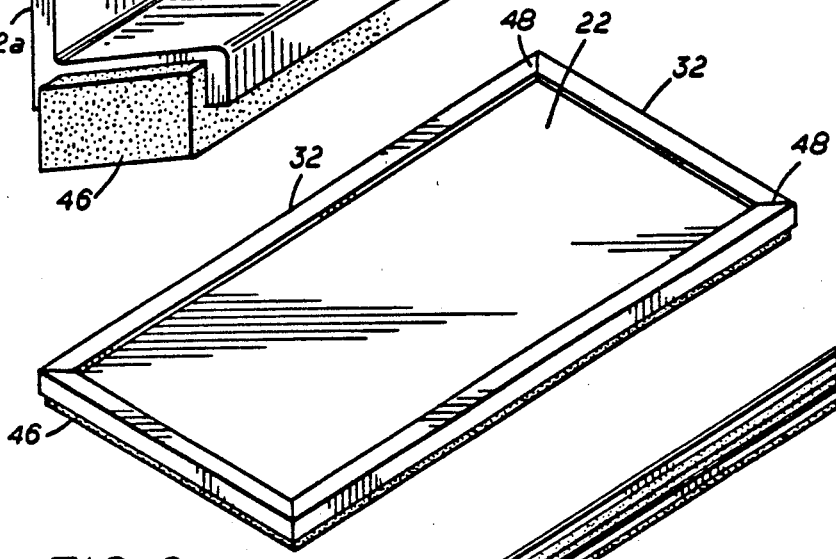
FIG. 6
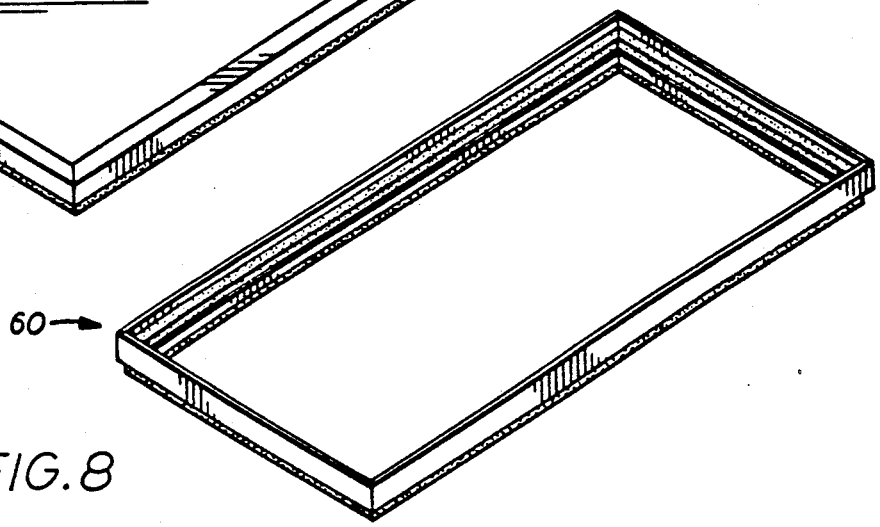
FIG. 8

CLEAN ROOM CEILING CONSTRUCTION

FIELD OF THE INVENTION

This invention relates to the art of suspension grid ceiling construction, and particularly to such ceilings employed in clean rooms.

BACKGROUND OF THE INVENTION

Suspension grid ceilings are widely used commercially and industrially. Such grid suspension ceilings typically include a plurality of horizontally flanged runners placed at 90° angles and suspended across a ceiling area so as to form square or rectangular grids in which ceiling panels are placed. With the advent of high technology industries, such as, for example, electronics, optics, telecommunications, robotics, medicine, and biotechnology, there is a need for such ceiling constructions which introduce a minimum of particles into the room. Such commercial and industrial environments are commonly referred to as clean rooms.

The conventional ceiling panels used in clean room construction are typically made of mineral fiber, fiberglass, gypsum or the like. These panels have a front surface disposed downwardly when the panel is placed in the suspension grid. The front surface is either smooth, or it may be perforated and/or contoured for sound absorption as in conventional acoustical ceiling panels. The front surface exposed to the interior of the room, as well as the reverse surface, when used in clean room systems, are typically sealed with a laminated facing of latex, aluminum or the like, to inhibit the release of particles from the ceiling panel into the clean room environment. Such surfacing is relatively effective in preventing the escape of particles from the exposed front surface of the ceiling panel to the clean room environment. However, a persistent problem heretofore has been the elimination of particles which escape from the edge of the ceiling panels, and/or the escape of particles from the space above the suspended ceiling into the clean room between the ceiling panel and the runners or horizontal flanges on which they are supported.

Various attempts have been made to prevent the introduction of particles into the clean room from or across the edges of the ceiling panels in the grid suspension system. Some relatively simple attempts have included sealing the ceiling panel edges and the use of a gasket material between the suspension grid horizontal flanges and the periphery of the front face of the ceiling panel. For example, it is known to seal the exposed edge surfaces of the ceiling panel with latex or a hard case adhesive. This has not been particularly effective because the edges of the ceiling panels are subject to damage by rubbing and/or bumping against the vertical portion of the runners in the ceiling grid suspension, particularly during installation and maintenance, and the edge sealant material tends to penetrate into the ceiling panel and make the edges brittle and flaky, particularly in the case of the hard case adhesives, thereby contributing to the generation of particles which escape into the clean room environment. A flexible tape has also been used to seal the edges of the ceiling panels, and while this has been relatively effective in inhibiting particle generation, it has been labor intensive as the edge of each ceiling panel must be taped manually prior to installation. This has significantly increased the cost and time of the installation.

Similarly, it has been known to use a foam adhesive tape to form a gasket or sealing surface between the ceiling panel and the horizontal flanges in the grid suspension system. Again, however, this installation is labor intensive in that the tape is applied manually to each horizontal flange and/or each ceiling panel at the installation site. An alternative to this has recently been the introduction of T-bar grid suspension runners, typically of aluminum, in which a channel is formed in the horizontal flange for placing the foam tape in the channel on the horizontal flange during manufacture thereof. However, this type of grid suspension system has been expensive because of the high cost associated with manufacturing the runners with the required profile, i.e. with the channel formed in the horizontal flange thereof. Moreover, this approach still does not address the need to seal the edge of each ceiling panel.

A more elaborate approach to preventing particle generation from and transmission through the grid suspension ceiling has been the use of runners in which a relatively deep channel is formed in the upward face of the horizontal flanges thereof. This type of grid system is typically suspended above the room, and then the channels in the horizontal flanges are filled with a jelly material which is heated and poured in a relatively liquid state into the channels of the runners. When the sealing liquid cools, it viscosifies and gels in the channels. This system is then used in conjunction with ceiling panels which are manufactured with an L-shaped flanged inserted into each edge of the ceiling panel. The L-shaped flange protruding from the ceiling panel is inserted into the jelly in the channel of each runner to suspend the ceiling panel in the grid system while forming a seal through immersion of the L-shaped flange of the ceiling panel into the jelly placed in the channel of the horizontal flanges on the grid suspension system.

In Jordan, Jr., et al. U.S. Pat. No. 3,084,402 there is described an acoustical panel with which tape and gaskets are used around the edge of the ceiling panel to prevent air and sound leakage past the edges of the panel.

In Soltis U.S. Pat. No. 4,603,618, there is described an air filtering distribution system in which filter membrane panels are suspended below the grid suspension ceiling system.

In Olson U.S. Pat. No. 3,325,954, there is described a ventilating ceiling system which employs various gaskets and other resilient sealing means at the periphery of the ceiling panel.

In Wilson U.S. Pat. No. 3,460,299, there is described a luminous sound absorbing ceiling which employs dual, parallel plastic films stretched across upper and lower surfaces of peripheral frames.

Various lighting fixture installations and grid suspension ceilings are described in Blum U.S. Pat. No. 4,272,804; Shorette U.S. Pat. No. 4,075,775; and Sutter U.S. Pat. No. 3,555,267.

Glass panes having profiled edges are described in Ohlenforst, et al. U.S. Pat. No. 4,775,570 and Kunert U.S. Pat. No. 4,477,507.

SUMMARY OF THE INVENTION

The present invention is directed to a suspension grid ceiling construction which effectively seals the edges of the ceiling panels to inhibit particle release therefrom into the clean room below, and which also seals the ceiling panels to horizontal flanges in the grid suspension system. The present invention also facilitates the sealing of the ceiling panel edges and significantly reduces the labor requirements for installation of the ceiling. This is accomplished by the use of prefabricated ceiling panel edge caps with edge sealing means and gaskets already in place, or prefabricated ceiling panels with such edge caps in place.

In one aspect the invention provides an assembly for sealing an edge of a grid suspension ceiling panel. The ceiling panel has opposite front and back horizontal surfaces and a generally vertical edge surface between the horizontal surfaces around a periphery of the ceiling panel. The assembly includes an elongated strip of generally U-shaped cross-section. First and second horizontal portions of the strip are joined in vertically spaced relationship by a vertical portion of the strip. The vertical portion of the strip corresponds in dimension to the ceiling panel vertical edge surface. The first and second horizontal portions of the strip are convergent away from the vertical portion thereof for compressively engaging the respective back and front horizontal surfaces of the ceiling panel at the periphery thereof. A fiber resistant gasket is secured to the strip on the second horizontal portion of the edge cap opposite the front panel member surface along the length thereof.

In another aspect, the invention provides a ceiling panel for use in clean room suspension ceilings which have peripherally horizontally flanged grid openings for receiving the ceiling panels. The ceiling panel includes a ceiling panel member having opposite front and back horizontal surfaces and a generally vertical, continuous edge surface between the horizontal surfaces around the periphery of the ceiling panel member. An edge cap engages and seals the ceiling panel member edge surface for inhibiting particle emission therefrom. The cap includes an elongated strip of generally U-shaped cross-section having first and second horizontal portions respectively compressively engaging the back and front panel member surfaces adjacent the edge surface. A vertical portion of the edge cap joins the horizontal portions and dimensionally corresponds to the panel member edge surface. A gasket is secured on the second horizontal portion of the edge cap opposite the front panel member surface for sealing the edge cap against a horizontal peripheral flange of a grid opening in the suspension structure to inhibit particle transmission through the suspension ceiling.

In still another aspect of the invention, there is provided a suspension ceiling for clean rooms. The ceiling includes a suspended ceiling support structure having a plurality of grid openings. Each grid opening includes a vertical member between grid openings and flanges extending horizontally from each of the vertical members so as to form a horizontal surface around a periphery of the grid opening for peripherally supporting a ceiling insert therein. At least one ceiling panel is positioned in a said grid opening and is peripherally supported by the flanges. The ceiling panel includes opposite front and back horizontal surfaces facing down and up, respectively, and a generally vertical continuous edge surface between the horizontal panel surfaces around the periphery of the panel. An edge cap sealingly engages the ceiling panel edge surface for inhibiting particle emission therefrom. The edge cap includes an elongated strip of generally U-shaped cross-section with first and second horizontal portions respectively compressively engaging the periphery of the back and front ceiling panel horizontal surfaces. A vertical portion of the strip joins the first and second horizontal strip portions adjacent the ceiling panel edge surface. A gasket is secured on the second horizontal portion of the edge cap facing downwardly toward the horizontal flange surface and compressed against the horizontal flange surface to form a seal between the edge cap and the flange around the periphery of the grid opening.

In a still further aspect of the invention, there is provided a gasket assembly for use with a light fixture supported on the horizontal flanges of a grid suspension ceiling. The light fixture gasket assembly includes an elongated strip of generally L-shaped cross-section having a vertical portion and a horizontal portion. The horizontal portion has upper and lower surfaces on opposite sides thereof. A fiber-resistant gasket is secured to the strip on the lower surface along the length thereof. Optionally, a fiber-resistant gasket is also secured to the strip on the upper surface along the length thereof.

BRIEF DESCRIPTION OF THE DRAWINGS

FIG. 4 is a perspective view of a ceiling panel edge sealing strip according to the present invention.

FIG. 5 is a cross-sectional view of a ceiling panel edge sealing strip and gasket prior to installation on a ceiling panel.

FIG. 6 is a perspective view of an assembled ceiling panel prior to installation using the strip seen in FIGS. 4 and 5.

FIG. 7 is a cross-sectional view of a light fixture sealing frame prior to installation according to the present invention.

FIG. 8 is a perspective view of an assembled light fixture frame prior to installation according to the present invention.

DETAILED DESCRIPTION OF THE PREFERRED EMBODIMENTS

Figure 1:
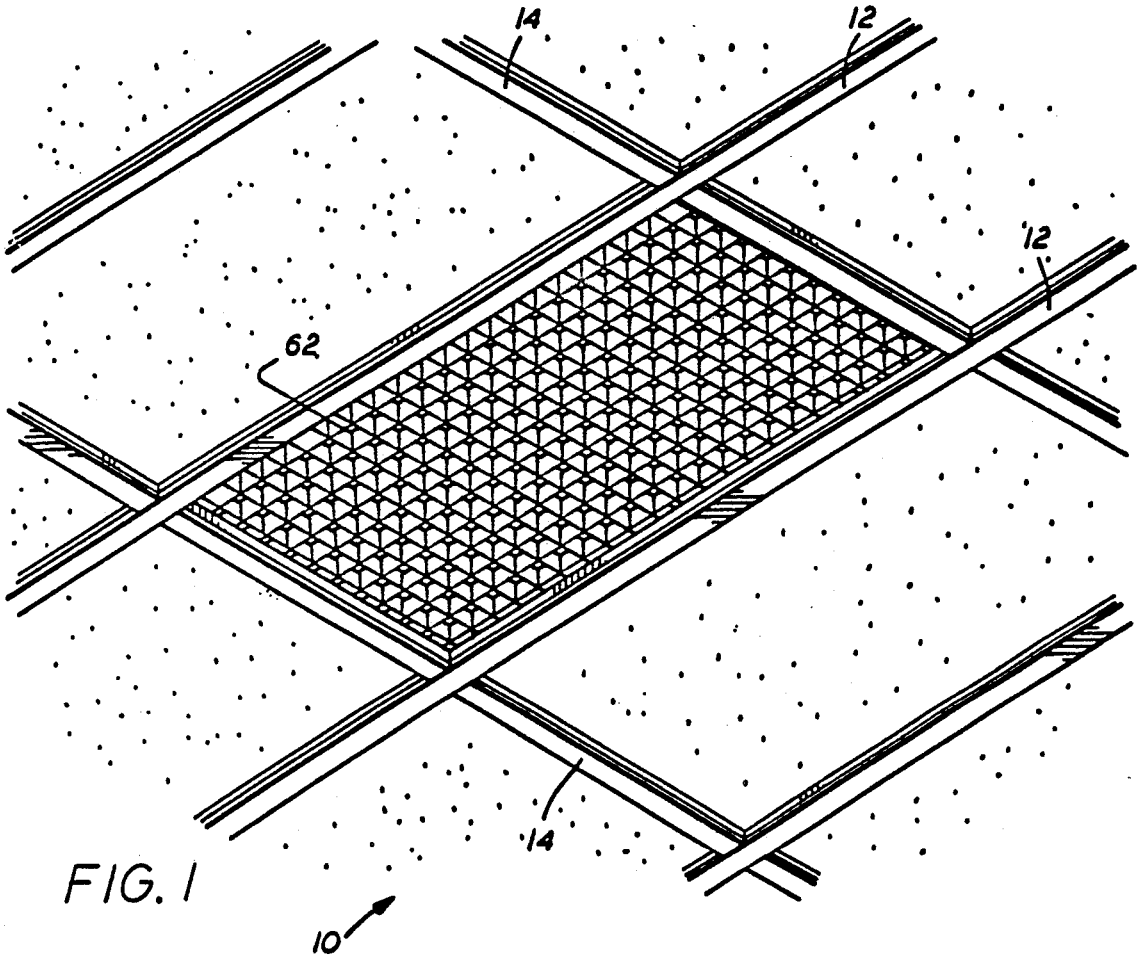
FIG. 1 illustrates a perspective frontal view of a clean room ceiling constructed in accordance with the present invention, and including a light fixture.
Figure 2:
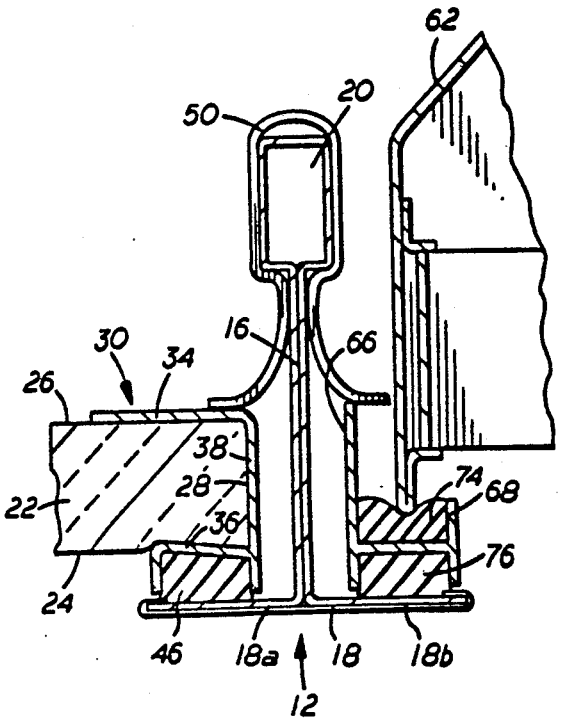
FIG. 2 is a cross-sectional view of a portion of a ceiling construction, including a T-bar suspension member, the edge of a ceiling panel (to the left), and a light fixture (to the right), all installed according to the present invention.
Figure 3:
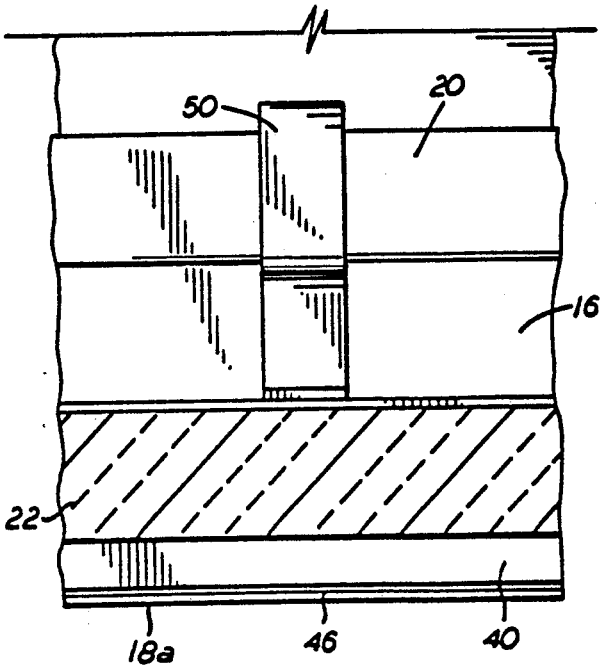
FIG. 3 is a perspective view, partly in section, of the ceiling construction of FIG. 2, as seen along the lines 3—3.

Referring now to the drawings, in which like parts are referenced by like numerals, a suspension ceiling system 10 is constructed with a conventional grid suspension system including a plurality of parallel main runners 12 and a plurality of cross T's 14 at right angles thereto so as to form a plurality of grid openings in the ceiling structure 10 (see FIGS. 1–3). The main runners are typically suspended from a super-structure (not shown) and attached at each wall using wall angle, as is conventional in the suspension ceiling art. Each runner and cross T includes a vertical portion 16 and a horizontal portion 18 forming horizontal flanges 18*a*, 18*b* on either side of the vertical portion 16. The runner 12 thus has a conventional T-bar construction, and may also include an enlarged portion 20 at an end of the vertical member 16 away from the horizontal portion 18. This conventional T-bar construction is used for the runners 12 as well as in the cross T's 14 so as to form a load-bearing horizontal flange around the entire periphery of each grid opening for supporting a panel, light fixture, or the like.

According to the present invention and as best seen in FIGS. 1–6, each ceiling panel 22 is made of a conventional material, such as, for example, mineral fiber, gypsum, fiberglass or the like, and includes a front surface 24 which is positioned downwardly and is exposed to the room below the ceiling, a rear surface 26 facing the superstructure and opposed from the front surface 24, and a vertical edge portion 28 around the entire periphery thereof. The ceiling panel 22 is thus of a conventional type and is not particularly critical in the present invention, and may also include a laminated or otherwise sealed front surface 24 for reducing particle emission and/or the front surface 24 may be perforated or contoured for sound absorption, as is conventional in the art.

According to the present invention, each ceiling panel 22 is placed in a frame structure 30 prior to assembly in the suspension system 10. The frame structure 30 serves as a particle barrier to seal the edge 28 of each ceiling panel 22, and also to support a gasket for sealing the ceiling panel 22 against the horizontal flange 18*a* around the entire periphery of the ceiling panel 22. The frame may be readily installed at the site of the ceiling installation, or the ceiling panels may be placed in the frame structure 30 and supplied to the installation site as a preassembled panel.

The frame structure 30 includes a plurality of generally longitudinal sections 32 for placement along each edge of the ceiling panel member 22. Each strip 32 may be manufactured from any suitable rigid or semi-rigid material such as, for example, aluminum, polyvinylchloride (PVC), high density polyethylene, linear low density polyethylene, polystyrene and the like. The particular material used is not especially critical, provided it has sufficient strength and rigidity to support a gasket and to clip onto the edge of the ceiling panel, as described in more detail hereinafter. The material should also be substantially impervious to fiber transmission from the edge of the ceiling panel 22, and is also desirably electrically and acoustically substantially non-conductive. The material of construction for the strip 32 is also preferably readily formed, for example, by molding, machining, or especially, by extrusion through a die having the desired profile. Since PVC, polyethylene and polypropylene meet all of these requirements, they are the preferred materials. The strip preferably is substantially the same color as the front surface 24 of the ceiling panel 22, although this is only an aesthetic consideration and is otherwise optional.

Each strip 32 has a generally U-shaped cross-section comprising a first horizontal portion 34 for engaging the rear surface 26 of the ceiling panel 22, a second horizontal portion 36 for engaging the front surface 24 of the ceiling panel 22 and a vertical portion 38 joining the first and second horizontal portions 34, 36 in vertically spaced relationship. The distance between the horizontal portions 34, 36 adjacent the vertical portion 38 should correspond to and approximate the vertical thickness of the ceiling panel 22. Conventional thicknesses are ½, ⅝ and ¾ inch depending on the size of the grid openings in the suspension ceiling construction 10, but any desired standard or nonstandard thicknesses may be used. The first and second horizontal portions 34, 36 tend to converge towards each other so as to be closer together away from the vertical portion 38 so that, prior to installation along the edge 28 of the ceiling panel 22, the vertical distance between the first and second horizontal portions 34, 36 is less than the thickness of the ceiling panel 22. This convergence should be sufficient to clamp the ceiling panel securely between the first and second horizontal portions 34, 36 of the strip 32, and will depend on the rigidity of the particular material from which the strip 32 is constructed, and the dimensions and strength characteristics of the ceiling panel 22. The convergence between the horizontal portions 34, 36 should not be too great or the insertion of the ceiling panel 22 into the strip 32 will not be facilitated.

A channel 44 may be formed, for example, on the second horizontal portion 36 between an inner projection 40 and an outer projection 42 which extend vertically adjacent opposite ends or sides of second horizontal portion 36 opposite ceiling panel 22. The channel 44 thus formed serves to receive a gasket 46 substantially along the entire length of the strip 32. The channel 44 serves to position and retain the gasket 46 in place along the edge of the assembled ceiling panel. The inner vertical projection 40 may preferably be positioned or disposed horizontally so as to substantially cover up and hide the gasket material from view, particularly where the gasket 46 is a different color than the material of strip 32. This is achieved by positioning the inner vertical projection 40 adjacent an end of the horizontal flange 18*a* away from the vertical portion 16. The outer vertical projection 42 may be made continuous with the vertical portion 38 so as to form a continuous edge surface along the length of the strip 32. The inner and outer vertical projections 40, 42 should extend substantially vertically from the second horizontal portion 36 sufficiently to retain the gasket 46, but the vertical dimensions thereof should not be so great as to interfere with compression of the gasket 46 between the second horizontal portion 36 and the horizontal flange 18*a*. Preferably, the vertical dimensions of the inner and outer vertical projection, 40, 42 are such that they do not abut the flange 18*a* upon installation, and their dimension is preferably less than approximately one-half that of the uncompressed gasket 46.

The gasket 46 may be made of any suitable gasket-forming material such as, for example, polyurethane foam tape. A closed-cell polyurethane foam tape is preferred as the gasket material because of its generally superior sealing properties and resistance to fiber transmission, although an open cell polyurethane foam may be employed provided that sufficient compression of the gasket 46 is obtained to insure a fiber-resistant seal. The gasket 46 is glued with an adhesive or otherwise adhered in place in the channel 44. The gasket 46 should be of sufficient horizontal width to fill the horizontal gap between the vertical projections 40, 42, but this width should not exceed the horizontal dimension between vertical projections 40 and 42 to facilitate receipt thereof in the channel 44. The vertical thickness of the uncompressed gasket 46 should be greater than the vertical dimensions of the vertical projections 40, 42, and preferably is approximately twice the vertical dimension of the projections 40, 42, so that when the gasket 46 is compressed against the horizontal flange 18*a*, the vertical projections 40, 42 do not abut the horizontal flange 18*a* or otherwise interfere with the sealing of the gasket 46 between the horizontal flange 18*a* and the second horizontal portion 36 of the strip 32. Of course, the relative vertical dimensions of the gasket 46 prior to compression against the horizontal flange 18*a*, and the vertical projections 40, 42, will depend on the compressibility of the gasket material 46 and the compressive forces thereon.

In a preferred embodiment, one-sided adhesive polyurethane foam tape is used as the gasket material 46. Such one-sided adhesive, closed-cell polyurethane tape is commercially available. A double-sided adhesive foam tape may alternatively be employed as the gasket 46, if desired, to adhere the gasket 46 to the horizontal flange 18*a*, but this is generally less preferred since maintenance involving removal of the ceiling panel 22 may result in damage and/or misalignment of the gasket 46.

Figure 2A:
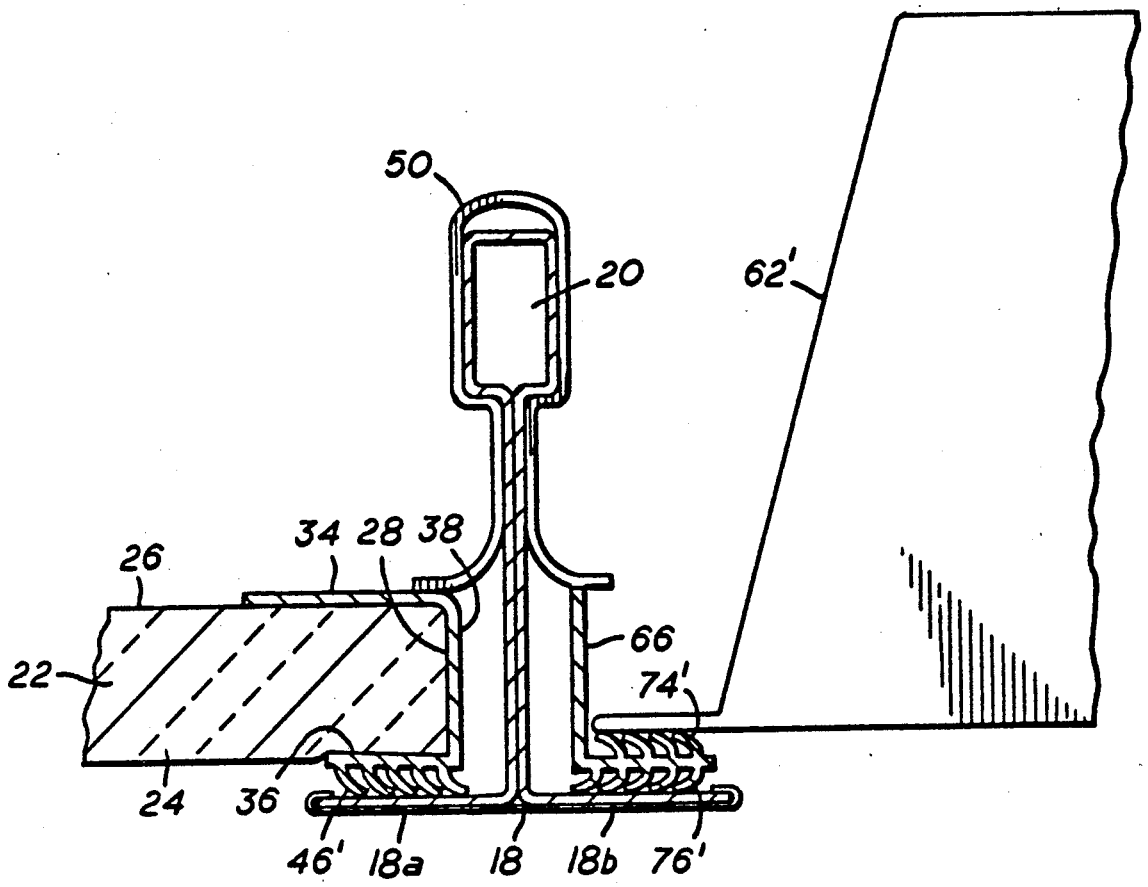
FIG. 2*a* is a cross-sectional view of an alternate embodiment of the ceiling construction seen in FIG. 2 according to the present invention.
Figure 5A:
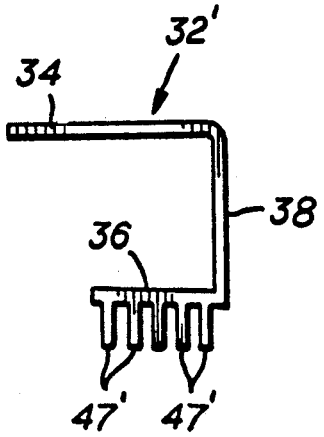
FIG. 5*a* is a cross-sectional view of an alternate embodiment of a dual durometer co-extruded edge sealing strip and gasket according to the present invention.

In another preferred embodiment, illustrated in FIGS. 2*a* and 5*a*, a gasket 46' may be secured to the horizontal portion 36, for example, by dual durometer coextrusion, in which case the channel 44 need not be employed since gasket 46' is directly secured to horizontal portion 36. The gasket 46' preferably comprises a plurality of vertically elongated strips or ridges 47 which are made of a softer material than that of horizontal portion 36 for forming the necessary seal against the flange 18*a*, e.g. semi-soft PVC fins coextruded with a rigid PVC strip. The ridges 47 deform and fold over into an overlapping configuration when compressed by the hold down clip 50 and/or the weight of the panel 22 to ensure a fiber-resistant seal. For aesthetic reasons, the gasket 46' preferably has the same color as that of the strip 32'.

For positioning a plurality of strips 32 around the entire periphery of ceiling panel 22, the strip 32 may be provided with beveled ends 32*a*, 32*b* to form mitered joints 48 at corners of the panel 22. The gasket 46 preferably extends beyond the ends 32*a*, 32*b* to overlap with a gasket in an adjacent strip to ensure a good seal at the joints 48.

The strip 32 may be conveniently beveled at each end 32*a*, 32*b* by cutting the extruded PVC strip at 45° angles, for example, at the desired dimension of the strip 32. Since the ceiling panels 22 are conventionally square or rectangular, the angle of the bevel at the ends 32*a*, 32*b* would typically be 45°, although a different angle may be used for forming the miter joints, if desired, and different angles will be used in the case of non-conventional ceiling panel shapes, e.g. octagonal. In any case, the angle of the bevel of one end 32*a* of the strip 32 will correspond to and complement the angle of an adjacent strip on the same ceiling panel 22 so that the adjacent strips are in abutment at the miter joints. If desired, the joints may additionally be secured and/or sealed by taping or clipping the adjacent strips together.

If desired, the ceiling panel 22, and the strips 32, including the gaskets 46 carried in the channel 44 thereof, may be assembled for supply to the installation site as a prefabricated grid ceiling insert. Alternatively, the strips 32, the ceiling panel members 22 and the gasket 46 may be supplied as component parts for assembly of the ceiling panel insert at the site of construction. The strip 32 may also be supplied as a component part without the beveled ends 32*a*, 32*b*, particularly where the ceiling panel insert 22 must be cut to size as around the edge of the grid suspension ceiling and adjacent projections where standard size ceiling panels cannot be used. In this instance, the ceiling panel 22 is cut to the appropriate size, and then the strip 32 is cut to a size corresponding to the cut ceiling panel and beveled, for example, with a scissors and clipped on to the edge of the panel 22.

Once the panel is installed in the grid opening in the suspension structure 10 it is preferably secured in place using a conventional hold down clip 50. The hold-down clip 50 is used to secure the panel 22 into place in the grid opening so that it is not easily or inadvertently displaced by bumping it. The hold-down clip 50 further serves to enhance the seal between the panel 22 and the flange 18*a* by compressing the gasket 46. In some instances, particularly where a relatively heavy material is employed for the ceiling panel 22, the hold-down clip 50 may not be necessary to compress the gasket 46.

The relative dimensions of the edge cap 30, as indicated above, are generally related to the size of the panel 22 and the size of the flange 18*a* with which it is employed. The dimension of the vertical portion 38 will generally correspond to the vertical dimension of the edge portion 28 of the panel 22. Where the dimension of the vertical portion 38 is significantly larger than the corresponding dimension of edge 28 of the panel 22, a fiber tight seal may not be achieved, whereas if the vertical portion 38 is smaller, the edge cap 30 might be difficult to clip onto the edge of the panel 22. The first horizontal portion 34 need not be any wider than necessary to adequately engage the edge of the panel 22 and preferably is 1–3 times the vertical dimension of vertical portion 38. The width of horizontal portion 36 on the front of the panel 22 should be sufficient to secure the gasket 46 thereto as well as to adequately engage the edge of the panel 22. However, for aesthetic reasons, it is preferred that the horizontal portion 36 not extend beyond the end of the flange 18*a* so that the gasket 46 will not be visible from the front of the ceiling, taking into consideration that there is normally a horizontal spacing, typically as much as ¼inch between the edge 28 of the panel 22 and the vertical portion 16 of the T-bar in order to facilitate insertion and removal of the ceiling panel 22 in the grid opening.

Referring now to FIGS. 2, 7 and 8, the suspension ceiling system 10 of the present invention may also include a gasket-carrying frame 60 for sealing the periphery of a light fixture 62 in a grid opening. The frame 60 includes an elongated strip 64 of generally L-shaped cross-section. The strip 64 includes an outer vertical portion 66, and an inwardly projecting horizontal portion 68. Upper and lower channels 70, 72 respectively, are formed on opposite faces of the horizontal portion 68, and are adapted to receive, respectively, gaskets 74, 76 in the manner described hereinabove with respect to gasket 46 in channel 44. Alternatively, the gasket 76 may be coextruded with the strip 64' as illustrated in FIG. 2*a*. The gasket 76 serves to form a seal between the strip 64 and the flange 18*b*, in a manner similar to that of gasket 46 and the strip 30 described hereinabove. Also, the gasket 74 functions to serve as a seal between the light fixture 62 and the strip 66 in a similar manner, although the gasket 74 is not always essential since light fixtures are sometimes supplied with a gasket for this purpose and/or the contact between the light fixture 62 and the channel 70 may be sufficient to create an adequate seal. Where the light fixture 62 has a vertical projection, the gasket 74 does not need to extend above the inner walls of the channel 70, and preferably does not. However, when the light fixture is not so equipped, the vertical dimension or thickness of the gasket 74 should exceed that of the inner wall of the channel 70 so that there is not interference with the seal.

Having described my invention above, many variations in the size, shape and construction will become apparent to those of ordinary skill in the art. It is intended that all such variations and modifications within the scope and spirit of the appended claims be embraced thereby.

What is claimed is:

1. A ceiling panel for use in clean room suspension ceilings having peripherally horizontally flanged grid openings for receiving ceiling panels, comprising:

a ceiling panel member having opposite front and back horizontal surfaces and a generally vertical, continuous edge surface between said horizontal surfaces around the periphery of said member;

an edge cap sealingly engaging said ceiling panel edge surface for inhibiting particle emission therefrom, said cap comprising an elongated rigid or semi-rigid strip of generally U-shaped cross-section having first and second horizontal portions respectively compressively engaging said back and front panel member surfaces adjacent said edge surface, and a vertical portion joining said horizontal portions and dimensionally corresponding to said panel member edge surface; and a longitudinal gasket secured to said second horizontal portion of said edge opposite said front panel member surface for sealing said edge cap against a horizontal peripheral flange of a suspension ceiling grid opening to inhibit particle transmission through the suspension ceiling, said gasket comprising a plurality of vertically elongated ridges.

2. The ceiling panel of claim 1, wherein the horizontal dimension of said second horizontal portion of said edge cap is less than three times the vertical dimension of said panel member vertical surface.

3. The ceiling panel of claim 1, wherein said panel member edge surface has a plurality of right angles forming corners and wherein said edge cap includes mitered joints for sealing said corners.

4. The ceiling of claim 3, wherein said gasket overlaps at said corners.

5. The ceiling panel of claim 1, wherein said ridges comprise a material softer than said edge cap.

6. The ceiling panel of claim 1, wherein said edge cap comprises rigid PVC and said ridges comprise semi-soft PVC fins coextruded therewith.

7. The ceiling panel of claim 1, wherein said ridges deform into an overlapping configuration when compressed.

8. A suspension ceiling for clean rooms, comprising:

a suspended ceiling support structure having a plurality of grid openings including a vertical member between each said grid opening and flanges extending horizontally from each said vertical member so as to form a horizontal surface around a periphery of each said grid opening for peripherally supporting a ceiling insert in said grid opening;

at least one ceiling panel positioned in a said grid opening and peripherally supported by said flanges, said ceiling panel including opposite front and back horizontal surfaces facing down and up, respectively, and a generally vertical continuous edge surface between said horizontal panel surfaces around the periphery of said panel;

an edge cap sealingly engaging said ceiling panel edge surface for inhibiting particle emission therefrom, said cap comprising an elongated rigid or semis-rigid strip of generally U-shaped cross-section having first and second horizontal portions respectively compressively engaging the periphery of said back and front ceiling panel horizontal surfaces, and a vertical portion joining said first and second horizontal strip portions adjacent said ceiling panel edge surface; and a gasket secured on said second horizontal portion of said edge cap compressed against said horizontal flange surface to form a seal between said edge cap and said flange around the periphery of said grid opening, said gasket comprising a plurality of elongated ridges deformed into an overlapping configuration by said compression.

9. The ceiling of claim 8, wherein said gasket is substantially concealed from view by said flange.

10. The ceiling of claim 8, further comprising means for holding said ceiling panel in said grid opening.

11. The ceiling of claim 10, wherein said holding means comprises a hold down clip secured to said grid opening vertical member and in engagement with said panel back horizontal surface.

12. The ceiling of claim 8, wherein said grid opening and said panel edge surface have a plurality of corresponding corners, and wherein said edge cap includes mitered joints for sealing said corners.

13. The ceiling of claim 8, wherein said ridges comprise a material softer than said edge cap.

14. The ceiling of claim 8, wherein said edge cap comprises said PVC and said ridges comprise semi-soft PVC fins coextruded therewith.

* * * * *